US010614352B1

(12) United States Patent
Davis et al.

(10) Patent No.: US 10,614,352 B1
(45) Date of Patent: Apr. 7, 2020

(54) COUNTING SYSTEM

(71) Applicant: DuBois Agricultural Engineering Incorporated, West Des Moines, IA (US)

(72) Inventors: Nathan Paul Davis, West Des Moines, IA (US); Robert William Wilson, Des Moines, IA (US); Jerry DuBois, West Des Moines, IA (US)

(73) Assignee: DUBOIS ARGRICULTURAL ENGINEERING INCORPORATED, West Des Moines, IA (US)

( * ) Notice: Subject to any disclaimer, the term of this patent is extended or adjusted under 35 U.S.C. 154(b) by 0 days.

(21) Appl. No.: 16/276,808

(22) Filed: Feb. 15, 2019

(51) Int. Cl.
*G06M 1/06* (2006.01)
*G06M 1/10* (2006.01)

(52) U.S. Cl.
CPC ..... *G06M 1/108* (2013.01)

(58) Field of Classification Search
CPC ..... G07F 19/20; G07F 19/202; G07D 11/14; G07D 11/40; G07D 9/00; G07D 11/50; B67D 1/0021
USPC ..... 235/375, 379, 103; 222/1
See application file for complete search history.

(56) References Cited

U.S. PATENT DOCUMENTS

| | | | | |
|---|---|---|---|---|
| 6,078,635 | A | 6/2000 | DuBois | |
| 8,687,194 | B2 | 4/2014 | DuBois et al. | |
| 2012/0216487 | A1* | 8/2012 | Henkel | B65B 5/103 53/167 |

* cited by examiner

*Primary Examiner* — Jamara A Franklin
(74) *Attorney, Agent, or Firm* — Zarley Law Firm, PLC

(57) ABSTRACT

A counting system has a dispensing assembly, a singulator assembly, a counting assembly, and a control system. The dispensing assembly distributes particles to the singulator assembly which separates the particles into a singulator path and delivers the singulated particles to the counting assembly where the particles are counted and the count displayed on an input and display device.

18 Claims, 5 Drawing Sheets

COUNTING SYSTEM

BACKGROUND OF THE INVENTION

This invention is directed to a counting system for seeds, pills and the like and more particularly, a counting system having a dispensing assembly, a singulator assembly and a counting assembly.

Devices for counting seeds, pills and the like are known in the art. Important is the ability to obtain an accurate count at a high speed. While current devices are useful, typically these devices are complex, expensive, and loud. Accordingly, a need exists in the art for a system that addresses these deficiencies.

An objective of the present invention is to provide a counting system that has a simple design and still provides an accurate count at high speed.

Another objective of the present invention is to provide a counting device that is quiet and less expensive to manufacture and/or use.

These and other objectives will be apparent to those having ordinary skill in the art based upon the following written description, drawings and claims.

SUMMARY OF THE INVENTION

A particle counting system includes a control system connected to a dispensing assembly, a singulator assembly, and a counting assembly. Preferably the dispensing assembly has a hopper that delivers particles to a dispensing member. The dispensing member has a rotor disposed within a cylindrical chamber of a housing that receives the particles and transports the particles to a discharge conduit where the particles are delivered to the singulator assembly.

The singulator assembly preferably has a cover, a rotatable cylindrical disk, and an outer wall connected to a bottom surface of the cover and is positioned to slideably engage the cylindrical disk. The outer wall has a pair of openings with one adjacent the counting assembly and another adjacent a clear out hopper. Each opening has a gate that is adapted to selectively move from open and closed positions.

Disposed within the outer wall, between the cover and the circular disk are first and second guide members. The guide members are positioned to separate the particles into a primary path, a by-pass path, and a singulator path. The second guide member is adjustable in relation to the outer wall to provide an opening to the singulator path that permits only one particle to pass. Particles are transported on the singulator path through an opening in the outer wall to the counting assembly.

Sensors are connected to the control system and positioned at the openings and the by-pass path. Based upon sensed information, the control system adjusts the rotational speed of the rotor and selected positions of the gates.

DETAILED DESCRIPTION OF THE PREFERRED EMBODIMENTS

Figure 1:
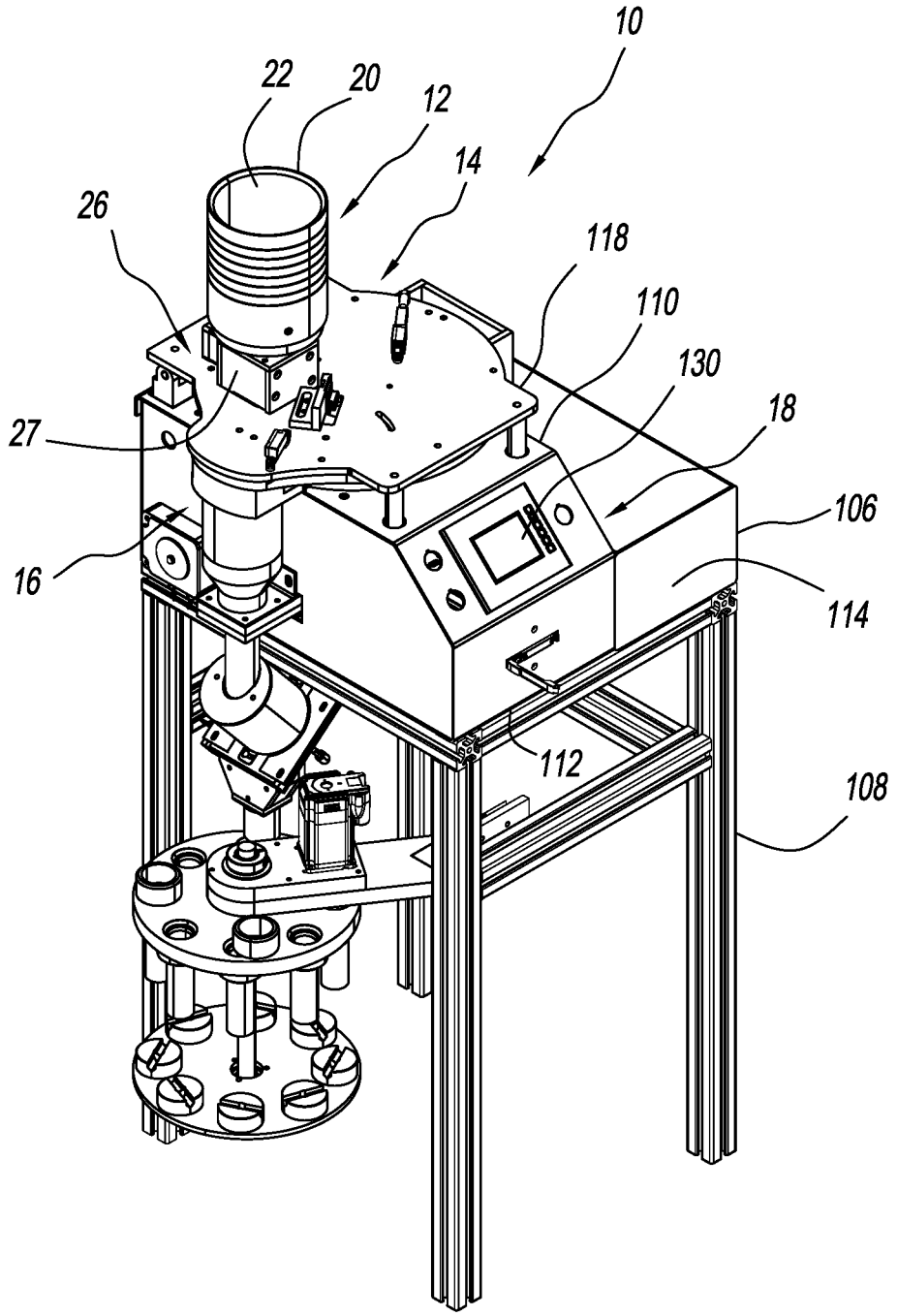
FIG. 1 is a perspective view of a counting system.
Figure 2:
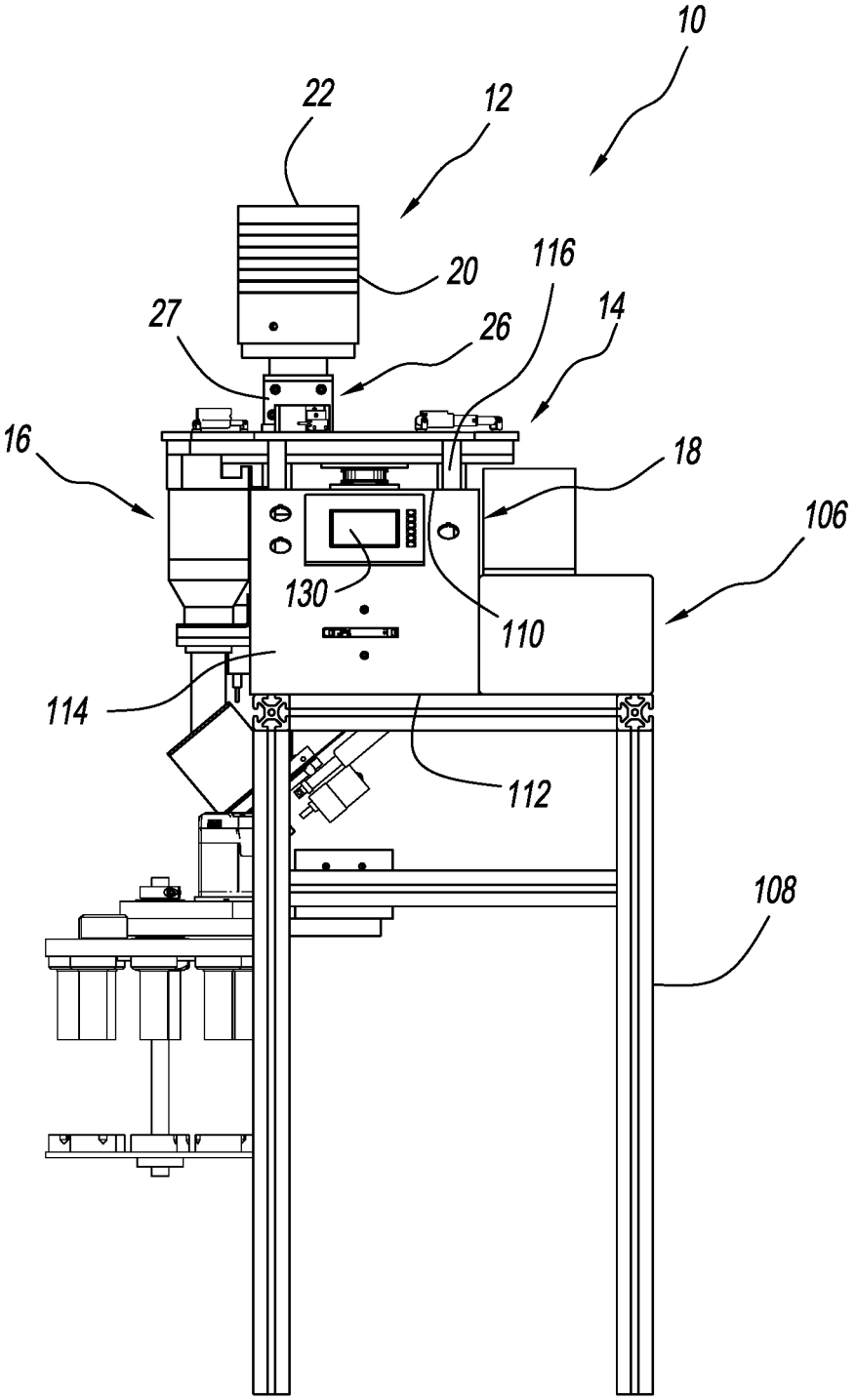
FIG. 2 is a side view of a counting system.
Figure 3:
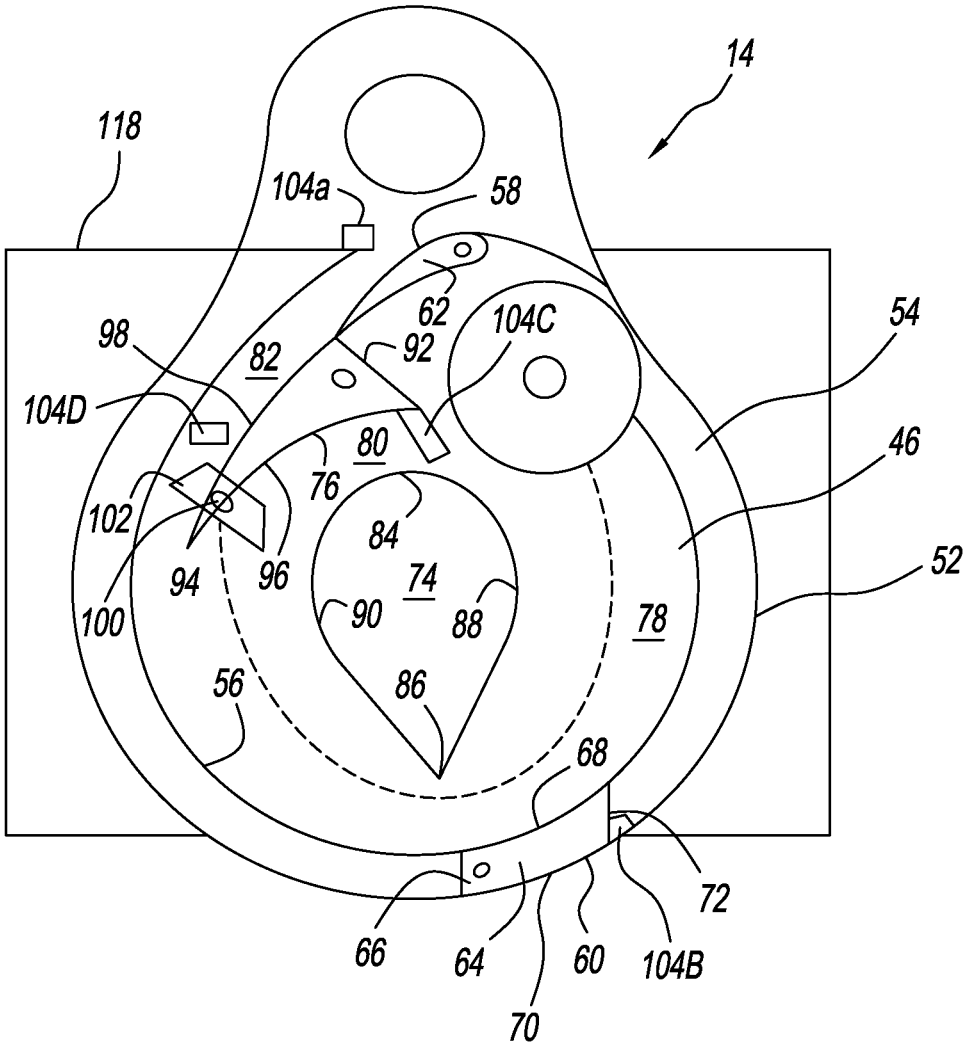
FIG. 3 is a top plan view of a counting system.
Figure 4:
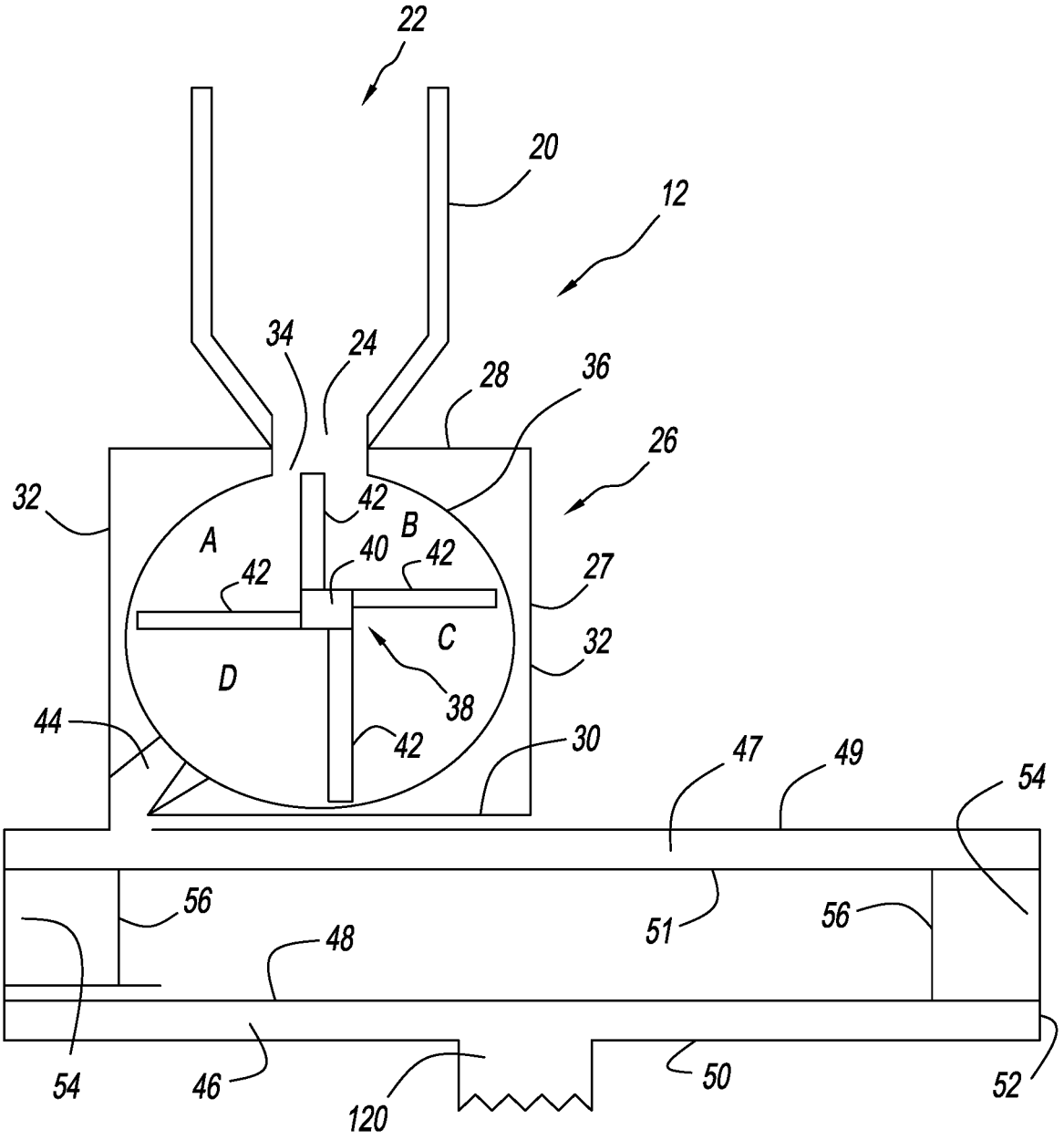
FIG. 4 is a side sectional view of a counting system.
Figure 5:
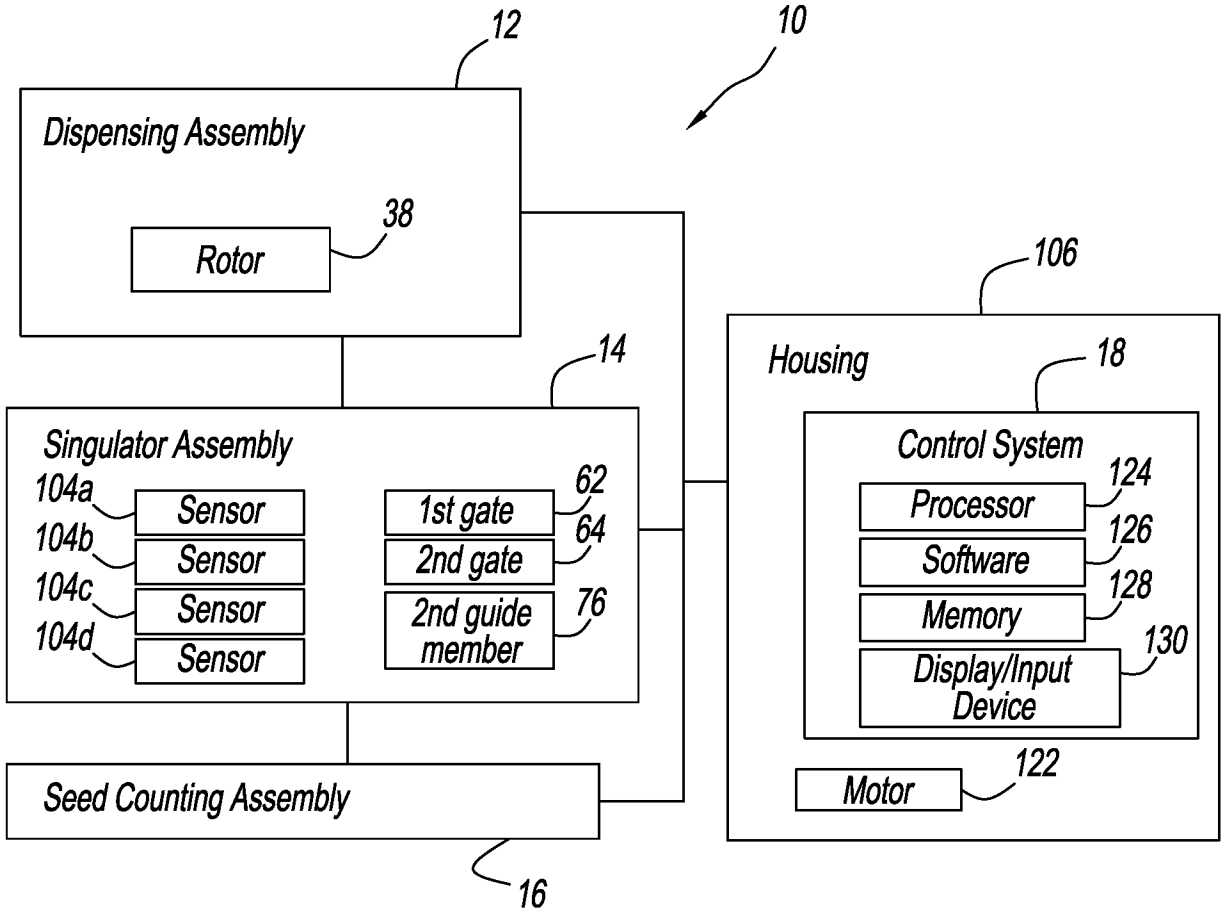
FIG. 5 is a schematic view of a counting system.

Referring to the Figures, a seed counting system 10, while described in the context of counting seeds, can also be used to count other small objects such as pills, or the like, without departing from the scope if the invention. The counting system 10 includes a dispensing assembly 12, a singulator assembly 14, a seed counting assembly 16, and a control system 18.

The dispensing assembly includes a hopper 20 having a funnel like shape with an open top 22 and a discharge opening 24 at the bottom. Connected below the hopper 20 is a dispensing member 26. The dispensing member 26 has a housing 27 with a top 28, a bottom 30, and side walls 32. The top 28 has an inlet port 34 that is aligned, and in communication with, the discharge opening 24 of the hopper 20. The housing 27 has a horizontally extending cylindrical chamber 36 that extends from one side wall 32 to an opposite side wall 32. Disposed within the cylindrical chamber 36 is a rotor 38. Preferably, the rotor 38 has a square drive shaft 40 connected to a step motor (not shown) and a plurality of resilient flaps or blades 42 that extend radially outwardly from the drive shaft 40 to the wall of the cylindrical chamber 36. The blades 42 divide the chamber 36 into quadrants A, B, C, and D. Extending from quadrant C of the cylindrical chamber 36, to a corner of a side wall 32, and the bottom 30 of the housing 27, is a discharge conduit 44.

Positioned below the dispensing assembly 12 is the singulator assembly 14. The singulator assembly 14 has a rotatable circular disk 46. The disk 46 preferably is made of metal and has a top surface 48, a bottom surface 50, and an outer peripheral edge 52. Positioned in parallel spaced relation to the circular disk 46 is a cover 47 that is preferably clear, having a top surface 49, a bottom surface 51, and an outer peripheral edge 53. Connected to the bottom surface 51 along the outer peripheral edge 53 is an outer wall 54. The outer wall 54 has an inner surface 56 that is smooth, and generally circular, and a bottom surface 57, that slidably engages the top surface 48 of the circular disk 46.

The outer wall 54 has a first or counting opening 58 and a second or clear out opening 60. Looking at the sorting assembly from the top, preferably, the first opening 58 is at nine o'clock and the second opening is at two o'clock. Positioned at the first and the second openings 58 and 60, and adapted to selectively open and close the openings 58 and 60, are a first and a second gate 62 and 64. While the gates 62 and 64 are of any size, shape and structure, in one example, the gates 62 and 64 have a first end 66, that is pivotally connected to the cover 47, and an inner surface 68 and an outer surface 70, that extend from the first end 66 and form a point 72 at an opposite end. Also, the inner surface 68 is arcuate so that when in a closed position the inner surface forms a smooth and continuous wall with the inner surface 56 of outer wall 54.

Positioned inwardly of the outer wall 54 and connected to the bottom surface 51 of the cover 47, are a first 74 and a second guide 76 member. The first and second guide members 74 and 76 extend vertically from the cover 47 and slidably engage the circular disk 46. The guide members 74 and 76 are positioned and configured to form a primary seed path 78, a by-pass seed path 80, and a singulator seed path 82. While the guide members 74 and 76 are of any size, shape, and structure, in one example, the first guide member 74 has a tear drop shape with an arcuate end 84, a pointed end 86, a first convex side 88, and a second convex side 90. The pointed end 86 is adjacent to, and directed toward, the clear out opening 60, the first side 88 forms part of the primary pathway 78, and the second side 90 forms part of the by-pass pathway 78.

The second guide member 76 preferably has a first square end 92, a second pointed end 94, a first concave side 96, and a second convex side 98. The first concave side 96 forms part of the by-pass seed path 80, and the second convex side 98 forms part of the singulator seed path 82. The first end 92 is pivotally connected to the cover 47, so that the pointed end 94, and the second convex side 98, move toward and away from the outer wall 54. In one example, a knob 100 is connected to the guide member 76 adjacent the pointed end 94. The knob 100 extends upwardly and away from guide member 76 through an arcuate slot 102 in the cover 47. The knob 100 permits an operator to move guide member 76 toward, and away from, the outer wall 54, to adjust the width of the singulator seed path 82.

Attached to the top surface 49 of the cover 47 are a plurality of sensors 104. The sensors 104 are positioned and adapted to monitor and detect operational parameters of the singulator assembly 14. For example, one or more sensors 104A and 104B are positioned to determine whether the first and second gates 60 and 62 are opened or closed. Another sensor 104C is positioned above the by-pass seed path 80 to detect the number of seeds that are flowing through the by-pass seed path 80. Yet another sensor 104D is positioned above an opening to the singulator seed path 82 to detect if seeds are flowing into the singulator seed path 82.

Adjacent the counting opening 58, and the first gate 62, is the seed counting assembly 16. The seed counting assembly 16 is of any size, shape, and structure, and preferably has the structure and function of the seed counting assembly disclosed in U.S. Pat. No. 8,687,194 by DuBois, herein incorporated by reference in its entirety. The seed counting assembly is positioned to receive seeds through the counting opening 58 of the outer wall 54.

Positioned below the singulator assembly 14 is a housing 106 supported by a frame 108. The housing 106 has a top wall 110, a bottom wall 112 and side walls 114. Extending upwardly from the top wall 110 of the housing 106 are a plurality of support members 116. The support members 116 are connected to a support frame 118 that is connected to, and extends outwardly from, the outer wall 54 of the singulator assembly 14. The seed counting assembly 16 is also connected to the support frame 118 and a side wall 114 of the housing 106.

Disposed within the housing 106 and extending through the top wall 110 of the housing 106 is a drive shaft 120. The drive shaft 120 is operatively connected to a motor 122 at one end, and the bottom surface 50 of the circular disk 46 at the opposite end, to rotate the circular disk 46.

Also disposed within the housing 106 is the control system 18. The control system 18 includes a processor 124, software 126, memory 128, and a display and input device 130, that extends through a side wall 114 of the housing 106. The control system 18 is connected to the dispensing assembly 12, the seed counting assembly 16, the first gate 62, the second gate 64, the sensors 104, the motor 122, and the display and input device 130.

In operation, the motor 122 is activated by manually engaging the input device 130. Upon activation, the motor causes the drive shaft 120 to rotate which in turn rotates disk 46. Seeds are then added to the hopper 20 through the open top 22 and through the inlet port 34 to rotor 38 within the cylindrical chamber 36. Rotation of the rotor 38 was activated by initial engagement with the input device 130 or alternatively through subsequent engagement. As the rotor 38 is rotated, the blades 42 transport the seed from the inlet port 34 to the discharge conduit 44 where the seed is transported from the cylindrical chamber 36 to the circular disk 46.

Upon receipt onto disk 46, the seed travels along the inner surface 56 of the outer wall 54 along the primary seed path 78. The seed travels along the primary seed path 78 past the pointed end 86 of the first guide member 74, until the seed reaches the pointed end 94 of the second guide member 76.

The position of the second guide member 76 is adjusted manually or mechanically, to create an opening between the inner surface 56 of the outer wall 54, and the pointed end 94 of the second guide member 76, a distance that permits a single seed to pass through into the singulator seed path 82. In one example, the adjustment of the second guide member 76 can be done manually by grasping the knob 100 and sliding along the arcuate slot 102 in the cover 47 by using manual force to overcome a frictional connection. Alternatively, the knob 100 is threadably attached to a shaft that permits selective tightening to hold guide member 76 in place.

Excess seeds that do not pass through to the singulator seed path 82 are deflected by the second guide member 76 to the by-pass seed path 80. More specifically, the excess seeds engage the first concave side 96 of the second guide member 76 and travel along the first concave side 96 through the space between the square end 82 of the second guide member 76 and the arcuate end 84 of the first guide member 74. Based on rotation of the disk 46, the excess seeds then travel along the first convex side 88 of the first guide member 74 until the excess seeds pass the pointed end 86 and rejoin the primary seed path 78.

The seeds in the singulator seed path 82 travel along between the inner surface 56 of the outer wall 54 and the second convex side 98 of the second guide member 76 to the first counting opening 58. The first gate 62 to counting opening 58 is opened upon activation of the rotor 38 or based upon a signal from sensor 104D that detects the presence of a seed in the singulator seed path 82. Sensor 104D sends a signal to the processor 124 which in turn sends a signal to activate gate 62 to move to an open position. Seeds in the singulator seed path 82 travel through the first counting opening 58 to the seed counting assembly 16 where the seeds are counted. The counted seeds pass through the seed counting assembly 16 for further processing such as seed treatment and/or packaging.

As seeds pass through the seed counting assembly 16 a signal is sent to the processor 124 where the number of seeds that pass through are tabulated and displayed. When the seed count reaches a predetermined or input number a signal is sent from the processor 124 that closes first gate 58 and opens second gate 64 to clear all seeds from circular disk 46.

Also, during the seed singulating and counting process, excess seeds in the by-pass seed path 80 are detected by sensor 104C. A signal is sent from sensor 104C to the processor 124. Based upon the number of seeds detected in the by-pass seed path 80, the processor 124 sends a signal to the dispensing assembly 12 that either increases or decreases the rotational speed of the rotor 38.

What is claimed is:

1. A counting system, comprising:

a control system connected to a dispensing assembly, a singulator assembly, and a counting assembly;

wherein the control system is adapted to dispense particles from the dispensing assembly to the singulator assembly, separate particles into a singulator path on the singulator assembly, transport particles from the singulator path to the counting assembly, and count particles; and wherein the dispensing assembly has a hopper connected to a dispensing member and the dispensing member has a rotor disposed within a cylindrical chamber.

2. The counting system of claim 1 wherein the singulator assembly has a cover, a rotatable circular disk, and an outer wall connected to a bottom surface of the cover and positioned to slidably engage the rotatable circular disk.

3. The counting system of claim 2 wherein a first and a second guide member are positioned between the cover and the rotatable disk to form a primary, a by-pass, and a singulator path.

4. The counting system of claim 3 wherein the outer wall has a first and a second gate that selectively open and close a first and a second opening in the outer wall.

5. The counting assembly of claim 4 wherein at least one sensor is associated with the first and second gates that sends a signal to the control system indicating whether the first and the second gate are open.

6. The counting assembly of claim 3 wherein the second guide member is pivotally mounted to the bottom surface of the cover and adapted to be moved toward, and away, from the outer wall.

7. The counting system of claim 1 wherein a sensor positioned above a by-pass path of the singulator assembly is connected to the control system and adapted to send a signal to the control system that adjusts a rotational speed of the dispensing assembly based upon the number of particles sensed in the by-pass path.

8. The counting system of claim 1 wherein a sensor positioned above a by-pass path of the singulator assembly is connected to the control system and adapted to send a signal to the control system that adjusts a rotational speed of the dispensing assembly based upon the number of particles sensed in the by-pass path.

9. A counting system, comprising:

a control system connected to a dispensing assembly, a singulator assembly, and a counting assembly;

wherein the control system is adapted to dispense particles from the dispensing assembly to the singulator assembly, separate particles into a singulator path on the singulator assembly, transport particles from the singulator path to the counting assembly, and count particles; and wherein the singulator assembly has a cover, a rotatable circular disk, and an outer wall connected to a bottom surface of the cover and positioned to slidably engage the rotatable circular disk.

10. The counting system of claim 9 wherein a first and a second guide member are positioned between the cover and the rotatable disk to form a primary, a by-pass, and a singulator path.

11. The counting system of claim 10 wherein the outer wall has a first and a second gate that selectively open and close a first and a second opening in the outer wall.

12. The counting assembly of claim 11 wherein at least one sensor is associated with the first and second gates that sends a signal to the control system indicating whether the first and the second gate are open.

13. The counting assembly of claim 10 wherein the second guide member is pivotally mounted to the bottom surface of the cover and adapted to be moved toward, and away, from the outer wall.

14. A counting system, comprising:

a control system connected to a dispensing assembly, a singulator assembly, and a counting assembly;

wherein the control system is adapted to dispense particles from the dispensing assembly to the singulator assembly, separate particles into a singulator path on the singulator assembly, transport particles from the singulator path to the counting assembly, and count particles; and wherein a sensor positioned above a by-pass path of the singulator assembly is connected to the control system and adapted to send a signal to the control system that adjusts a rotational speed of the dispensing assembly based upon the number of particles sensed in the by-pass path.

15. The counting system of claim 14 wherein the singulator assembly has a cover, a rotatable circular disk, and an outer wall connected to a bottom surface of the cover and positioned to slidably engage the rotatable circular disk.

16. The counting system of claim 15 wherein a first and a second guide member are positioned between the cover and the rotatable disk to form a primary, a by-pass, and a singulator path.

17. The counting system of claim 16 wherein the outer wall has a first and a second gate that selectively open and close a first and a second opening in the outer wall.

18. The counting assembly of claim 16 wherein the second guide member is pivotally mounted to the bottom surface of the cover and adapted to be moved toward, and away, from the outer wall.

* * * * *